US006397714B1

(12) United States Patent
Borel

(10) Patent No.: US 6,397,714 B1
(45) Date of Patent: Jun. 4, 2002

(54) SYSTEM FOR ADJUSTING THE POSITION BETWEEN A WASTE EJECTOR AND A CUTTING CYLINDER

(75) Inventor: Edouard Borel, Dommartin (CH)

(73) Assignee: Bobst SA (CH)

( * ) Notice: Subject to any disclaimer, the term of this patent is extended or adjusted under 35 U.S.C. 154(b) by 0 days.

(21) Appl. No.: 09/567,636

(22) Filed: May 9, 2000

(30) Foreign Application Priority Data

Jun. 1, 1999 (CH) ..... 1026/99

(51) Int. Cl.[7] ..... B26D 7/18

(52) U.S. Cl. ..... 83/118; 83/121; 83/145; 83/151; 83/345; 83/161; 83/698.31

(58) Field of Search ..... 83/118, 121, 122, 83/145, 151, 154, 105–107, 112, 113, 115, 116, 345, 161, 698.31, 698.51, 698.41, 698.61, 699.51, 699.61; 493/373, 472, 342

(56) References Cited

U.S. PATENT DOCUMENTS 2,024,404 A * 12/1935 Van Berkel ..... 83/154 X
2,341,956 A * 2/1944 Staude ..... 83/120
3,893,359 A * 7/1975 Gregorie ..... 83/154
5,303,623 A * 4/1994 Chiloff ..... 83/121

* cited by examiner

*Primary Examiner*—Boyer Ashley
(74) *Attorney, Agent, or Firm*—Ostrolenk, Faber, Gerb & Soffen, LLP

(57) ABSTRACT

The cutting cylinder of a rotary cutting machine has at least one radial needle for retaining waste projecting radially from its surface. A waste ejector has a rectilinear part parallel to the generatrix of the said cylinder and traversed by at least one slot coinciding with the trajectory of said radial needle for the passage thereof. A support has a first part secured to the frame of the rotary cutting machine, a second part secured to said ejector and connected to the first part by a guide defining a transverse trajectory relative to the edge of said ejector and intersecting said cylinder. An adjustment device moves the said second part along the transverse trajectory and an elastic connection exerts a prestressing of the second part on the adjustment device.

17 Claims, 2 Drawing Sheets

SYSTEM FOR ADJUSTING THE POSITION BETWEEN A WASTE EJECTOR AND A CUTTING CYLINDER

BACKGROUND OF THE INVENTION

1. Field of the Invention

This invention relates to a system for adjusting the position between a waste ejector and a cutting cylinder for material in strip form in a rotary cutting machine, cylinder comprising at least one radial needle for retaining waste and projecting radially from its surface, ejector having a rectilinear part parallel to the generatrix of the cylinder and traversed by at least one slot coinciding with the trajectory of radial needle for the passage thereof.

2. Description of Related Art

When the cardboard waste is separated from a strip during its cutting for the manufacture of folding boxes in particular, on rotary cutting machines, it is essential that the waste should be ejected controllably to prevent it causing any jamming. To this end, one of the two cutting cylinders between which the strip of cardboard is cut comprises radial needles between the cutting fillets, which needles penetrate the waste during a cutting operation and separate it from the strip, entraining it with the cylinder, while the strip moves away from the cylinder following a horizontal trajectory.

This waste must then be extracted from radial needles during rotation of the cylinder in order to free radial needles and enable them to penetrate other waste during their next passage in the cutting zone of the cardboard strip. To this end, ejectors are provided in the form of fixed combs with edges parallel to the cylinder generatrix, cut out so that they can very closely approach the trajectory of the cutting fillets of the cylinder while allowing the radial needles projecting beyond the apices of said cutting fillets to pass. The edges of the ejectors can thus be inserted between the apices of the cutting fillets and the waste and extract the waste from the radial needles when the latter move away from the ejectors following the rotation of the cylinder.

The edges of these combs must be positioned with high precision with respect to the cylinder. If too large a spacing is left between the apices of the cutting fillets and the edges of the combs, there is a risk that the cardboard waste will pass between the comb and the fillet. This may initially result in a deformation of the comb and may also break the radial needle and hence a fillet. The damage increases generally with rotation of the cylinder, until the machine stops. If, on the other hand, the distance is too small, there is a risk that the comb will come into collision with a cutting fillet and also cause damage successively until stoppage of the machine.

Since the comb is subjected to impacts whenever it meets waste, and in view of the very small tolerances allowed for its positioning, it not only has to be positioned with very high accuracy but must also be prevented from vibrating, since otherwise the said two risks can occur more or less simultaneously on different combs.

To guarantee reliable operation of a waste ejector of the type referred to, it must satisfy an extremely strict specification. The positioning of the comb must be possible with a tolerance of not more than ±0.02 mm. Its rigidity may not allow a movement in excess of 5 $\mu$m, even in response to impacts. The comb must not undergo any torsion irrespective of the axis considered.

To be able to satisfy the above positioning accuracy, there must be an adjustment system. Conventional adjustment systems assume the existence of a guide for each adjustment axis. Consequently, the movable element must be locked on the guide once it has reached the required position,-and this implies a displacement with respect to the desired position, induced by the locking. It is therefore necessary to proceed by repetition and this repetition method which is more or less carried out at random involves the risk that the final precision accepted will be only approximate, together with the danger that implies.

The use of cross-guides with locking, which is well known in machine tools, would give a solution which is considered expensive in the area of folding box manufacture and hence economically unacceptable. Finally, it is difficult to have access to means for adjustment along the different axes on one and the same surface of the component requiring adjustment, so that the adjustment operation is rendered difficult.

The object of this invention is to obviate the above disadvantages at least partly.

BRIEF SUMMARY OF TEE INVENTION

To this end, the invention relates to a system for adjusting the position between a waste ejector and a cylinder for cutting material in strip form in a rotary cutting machine.

The system according to the invention has few components and is compact and economic. Its design, in which the prestressed strips connecting the two parts of the support act as a guide without any play, results in an adjustment which does not depend on any hysteresis effect and which has an excellent resolution. The system has a very good rigidity both static and dynamic in the three axes, including the axis along which the adjustment is made. Its static and dynamic torsion rigidity is high along the three axes. The adjustment components of the system have orientations directed towards the exterior of the machine which are easily accessible. The adjustment and dismantling can be effected by means of one and the same key, simplifying to the maximum the various interventions required on the machine.

Other features and advantages will be apparent from the following description of one embodiment of this system which is illustrated diagrammatically and by way of example in the accompanying drawing wherein:

DETAILED DESCRIPTION OF THE INVENTION

Figure 1:
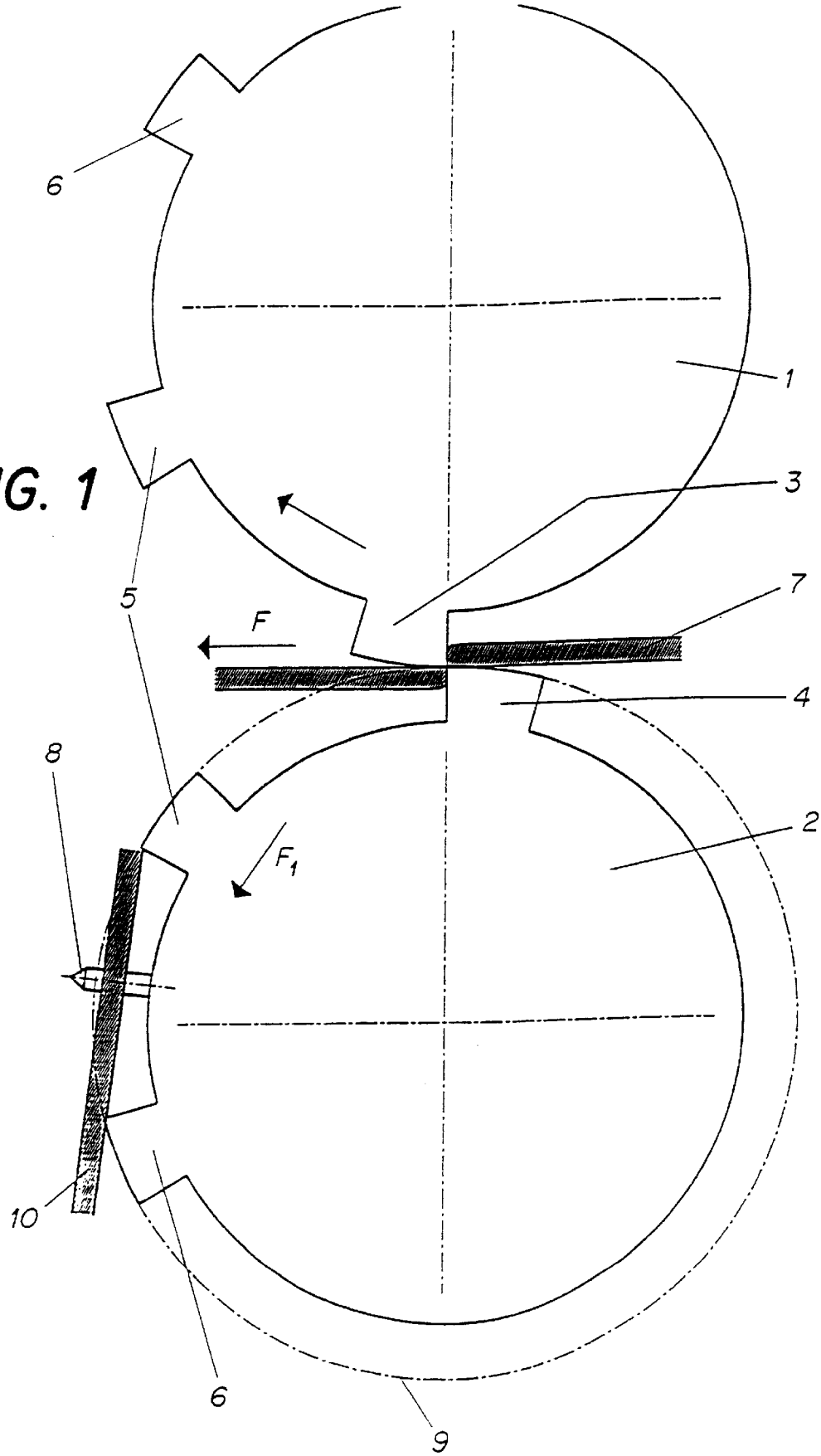
FIG. 1 is a side elevation of two cutting cylinders which are deliberately shown out of scale in order to explain the underlying problem.

The cutting cylinders 1, 2 shown in FIG. 1 constitute a cutting unit of a rotary cutting machine which may comprise a plurality of units side by side. Rotary cutting machines of this kind are generally used to cut cardboard into strip for the purpose of the manufacture of folding boxes.

These cutting cylinders 1, 2, which in this example are of the type cutting by shearing, more usually designated as rotary pressure cut or RP cylinders, comprise on their respective surfaces a network of cutting fillets 3, 4, 5, 6 respectively. This invention could also be applied to the case of cutting cylinders operating by compression and generally denoted by the logo CRC. A strip of cardboard 7 moves horizontally in the direction of the arrow F between said cutting cylinders 1, 2 and is cut when two cutting fillets 3, 4 of these two respective cylinders 1, 2 are in the relative position shown in FIG. 1.

The cardboard waste produced during the cutting operation must be ejected controllably in order to prevent it from causing jamming. To this end, one of the two cutting cylinders 1, 2, preferably the lower cylinder 2, is provided with radial needles 8 which project radially outside a circle 9 corresponding to the trajectory described by the apices of the cutting fillets 4–6 around the axis of rotation of the cylinder 2. The radial needles are appropriately positioned on the surface of the cylinder 2 at places where cutting of the cardboard strip 7 produces waste 10. Thus these radial needles pierce the strip of cardboard 7 simultaneously with the cutting of waste 10 so that when the cardboard strip 7 continues its horizontal trajectory in the direction of the arrow F the waste 10 is driven in a circular trajectory around the cylinder 2 in the direction of the arrow F1 and is thus separated from the cardboard strip 7.

Obviously it is essential to proper operation of the cutting machine that the waste 10 should be detached from the radial needle 8 so that the latter can extract waste on each revolution of the cutting cylinder 2. This extraction of the waste 10 for its controlled ejection is produced by means of an ejector in the form of a comb which must be capable of insertion between the fillet 6 and the waste 10.

Figure 2:
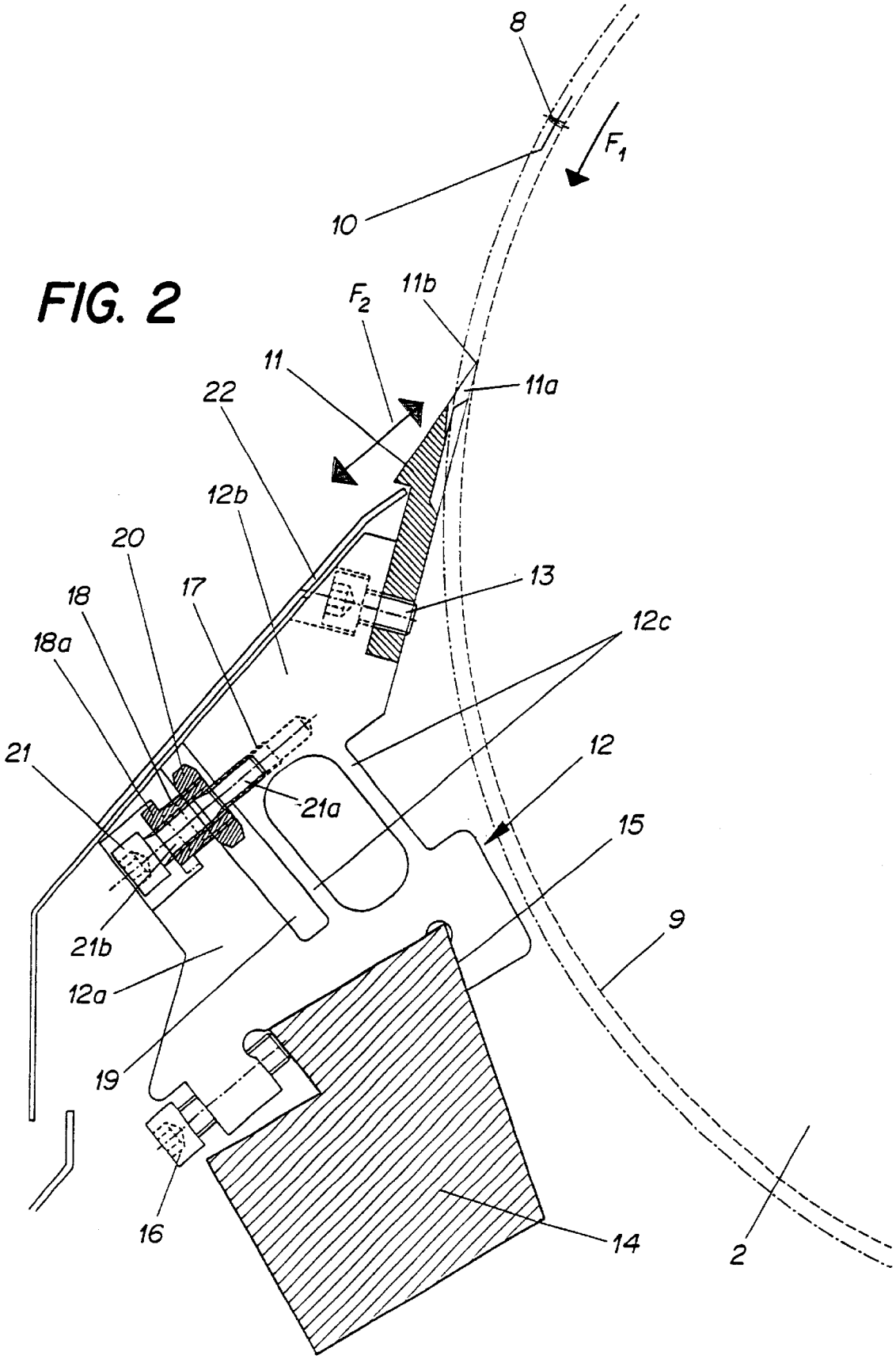
FIG. 2 is an enlarged-scale partial side view of a cutting cylinder as shown in FIG. 1 with the embodiment of the ejection system according to the invention.

FIG. 2 illustrates a comb 11 of this kind, showing a portion of the lower cutting cylinder 2 and a radial needle 8 on which waste 10 has been stuck. The comb 11 comprises a slot 11*a* directed perpendicularly to its front edge 11*b* which is parallel to the generatrix of the cylinder 2. This slot 11*a* is disposed on the circular trajectory described by the radial needle 8 around the axis of rotation of the cutting cylinder 2, to allow passage of the radial needle 8 so that the front edge 11*b* of the comb 11 can very closely approach the trajectory 9 of the apex of the cutting fillets 4–6, so that it can engage between trajectory 9 and the waste 10.

Said comb 11 is positioned and fixed on a support 12 by fixing screws 13. Said support 12 is in turn fixed to the frame (not shown) of the cutting machine by means of a rail or guide cross-member 14 engaging a support flange 15 formed on the support 12, so that the latter can be fixed on the cross-member 14 by screws 16. If the support 12 is moved along the guide cross-member 14, the slot 11*a* of the comb 11 can be made to coincide with the circular trajectory of the radial needle 8.

The support 12 comprises two parts, one 12*a* secured to the support flange 15, the other 12*b* connected to the comb 11. These two parts are interconnected by two parallel flexure strips 12*c*. The respective planes of these flexure strips 12*c* are substantially tangential to two circles concentric to the cutting cylinder 2, so that the part 12*b* can move within the limit of elastic deformation of the strips 12*c* in the direction of the double arrow F2. Consequently, the parallel strips 12*c* form as it were a deformable parallelogram so that they can primarily have a guide role, defining a displacement of the comb 11 along a trajectory perpendicular to the edge 11*b* of said comb 11, which intersects the cylinder in such manner that the distance between the edge 11*b* of the comb 11 and the cylinder 2 can be modified. These strips 12*c* thus act as a return means within the limit of their elastic deformation, the function of which will be apparent hereinafter.

The part 12*b* of the support 12 has a screwthread 17, the axis of which is perpendicular to the planes of flexure strips 12*c*. A tapped and screwthreaded bushing 18 terminating in a collar 18*a* at one end is introduced into an opening in the fixed part 12*a* of the support 12 formed coaxially to the screwthread 17. Bushing 18 is held by its collar 18*a* and projects into a space 19 formed between the fixed part 12*a* and the movable part 12*b* of the support 12. A nut 20 is engaged over the screwthreaded part of the bushing 18 in order to fix it to the fixed part 12*a*.

The internal tapping of the bushing 18 and the internal tapping 17 of the movable part 12*b* have different respective pitches. In the example described, the pitch of the tapping 17 is greater than that of the bushing 18. An adjustment screw 21 has two successive screwthreaded sections, an end section 21*a* engaged in the tapping 17 of the movable part 12c and a section 21*b* engaged in the tapping of bush 18. Since the pitch of the tapping 17 is greater than that of the bush 18, when the adjustment screw 21 is screwed it pulls the movable part 12*b* against the fixed part 12*a* of the support 12, causing the strips 12*c* to flex, so that the edge 11*b* of the comb 11 is moved away from the trajectory 9 of the edges of the cutting fillets 4–6.

By arranging for the flexure strips 12*c* always to operate from the same side of their neutral position, the problem of taking up the play between the threads of the screwthreads and those of the tappings does not arise, since the strips constantly exert thereon a prestressing always extending in the same direction.

The force exerted by the impacts produced on the meeting between a comb 11 and waste 10, has no influence on the adjustment system. In fact, the main component of this force occurs in a direction substantially parallel to the strips 12*c* and has no appreciable influence likely to produce micromovements by taking up the play between the screwthreads and tapping of the adjustment system 17, 18, 21.

By way of example, the difference in the pitches of the screwthreads 21*a*, 21*b* of the adjustment screw 21 produces a displacement of 0.25 mm between the movable part 12*b* and the fixed part 12*a*, for each revolution of the adjustment screw 21, corresponding to 0.7 $\mu$m for a 1 degree rotation. It is a simple matter to dimension the strips 12*c* so as to obtain an adjustment travel of the order of 0.5 mm without plastic deformation. In one embodiment of the adjustment system according to the invention, the strips 12*c* have a thickness of 5 mm, a length of 28 mm and a width of 42 mm, corresponding to the width of the support 12. It is interesting to note that the length of the parallel strips 12*c* is substantially equal to their width, and this gives excellent resistance to torsion.

Of course a number of supports 12 can be positioned along the cross-member 14 depending on the respective positions and the number of waste items to be removed on each revolution of the cutting cylinder 2, each of said supports 12 bearing a comb 11 whose slot 11*a* coincides with a circular trajectory of a radial needle 8. A plate 22 extending over the entire length of the cutting cylinders 1, 2 covers the support assembly 12. It is situated in extension of the top surface of the comb 11. It enables the adjustment systems to be protected while facilitating the flow of the waste 10, preventing the same from sticking, for example, to the slot 19.

The adjustment of the position of the comb 11 in its two axes of movement is obtained by means of two screws 16, 21 which are accessible on the same surface of the support 12 oriented parallel to the cylinder 2 and hence easily accessible. A single key enables these adjustments to be carried out, and the same applies to the removal of the support 12 or replacement of the comb 11.

What is claimed is:

1. A system for adjusting relative positions between a waste ejector and a rotating cutting cylinder in a rotary strip cutting machine, the cylinder having an axis of rotation, an outer surface and at least one needle that projects radially from the outer surface of the cylinder for retaining cutting waste, the ejector having a rectilinear part that extends parallel to the axis of rotation of the cylinder and is traversed by at least one slot through which the needle passes as the cylinder rotates, the system being comprised of:

a supporting device, the supporting device including:

a first part securable to a frame of the rotary cutting machine;

a second part secured to the ejector and connected to the first part by a guide member that defines a transverse trajectory for relative movement between the first and second parts along a line that intersects the cylinder and permits adjustment of the position of an edge of the ejector relative to the surface of the cylinder; and an adjusting device that permits the second part to be positioned along the transverse trajectory, the guide member including an elastic element comprised of two parallel elastic strips interconnecting the two parts of the supporting device for prestressing the second part relative to the adjusting device.

2. A system according to claim 1, wherein the pressure of the prestress is exerted in a direction forming an angle close to 90° with the force transmitted to the second part of the supporting device resulting from the impacts of waste on the ejector.

3. A system for adjusting relative positions between a waste ejector and a rotating cutting cylinder in a rotary strip cutting machine, the cylinder having an axis of rotation, an outer surface and at least one needle that projects radially from the outer surface of the cylinder for retaining cutting waste, the ejector having a rectilinear part that extends parallel to the axis of rotation of the cylinder and is traversed by at least one slot through which the needle passes as the cylinder rotates, the system being comprised of:

a supporting device, the supporting device including:

a first part securable to a frame of the rotary cutting machine;

a second part secured to the ejector and connected to the first part by a guide member that defines a transverse trajectory for relative movement between the first and second parts along a line that intersects the cylinder and permits adjustment of the position of an edge of the ejector relative to the surface of the cylinder; and an adjusting device that permits the second part to be positioned along the transverse trajectory, the guide member including an elastic element that prestresses the second part relative to the adjusting device;

the adjusting device is comprised of a rod having axially spaced first and second screwthreadings of different pitch respectively engaging in two axially aligned internal tappings that extend in the direction of the transverse trajectory and are respectively secured to the first and second parts of the supporting device.

4. A system according to claim 3, wherein he tapping secured to the first part of the supporting device is formed in a bushing, the bushing having a support collar at one end which engages the first part of the supporting device.

5. A system according to claim 4, wherein the bushing includes a portion at a second end opposite to the first end that projects into a space separating the first part and second part and is screwthreaded to allow the bushing to be locked in place by means of a nut.

6. A system for adjusting relative positions between a waste ejector and a rotating cutting cylinder in a rotary strip cutting machine, the cylinder having an axes of rotation, an outer surface and at least one needle that projects radially from the outer surface of the cylinder for retaining cutting waste, the ejector having a rectilinear part that extends parallel to the axis of rotation of the cylinder and is traversed by at least one slot through which the needle passes as the cylinder rotates, the system being comprised of:

a supporting device, the supporting device including:

a first part securable to a frame of the rotary cutting machine;

a second part secured to the ejector and connected to the first part by a guide member that defines a transverse trajectory for relative movement between the first and second parts along a line that intersects the cylinder and permits adjustment of the position of an edge of the ejector relative to the surface of the cylinder; and an adjusting device that permits the second part to be positioned along the transverse trajectory, the guide member including an elastic element that prestresses the second part relative to the adjusting device, the first part of the supporting device is connected to the frame of the rotary cutting machine by a support flange engaging a cross-member parallel to the axis of rotation of the cylinder, and further including a locking device that fixes the supporting device along the cross-member.

7. A system according to claim 6, wherein the adjusting device and the locking device are accessible on outer surfaces of the supporting device situated in planes parallel to the axis of rotation of the cylinder.

8. A system according to claim 6, further including a plurality of supporting devices, each of the supporting devices being in engagement with the cross-member, and each associated with one of a plurality of ejectors.

9. A rotary strip cutting machine including:

a first and a second rotating cutting cylinder, the first cylinder having an axis of rotation, an outer surface and at least one needle that projects radially from the outer surface of the cylinder for retaining cutting waste, a waste ejector having a rectilinear part that extends parallel to the axis of rotation of the first cylinder and is traversed by at least one slot through which the needle passes as the first cylinder rotates, a supporting device for positioning the waste ejector relative to the first cylinder, the supporting device including:

a first part secured to a frame of the rotary cutting machine;

a second part secured to the waste ejector and connected to the first part by a guide member that defines a transverse trajectory for relative movement between the first and second parts along a line that intersects the first cylinder and permits adjustment of the position of an edge of the ejector relative to the surface of the first cylinder;

an adjusting device that permits the second part to be positioned along the transverse trajectory, the guide member including an elastic element that prestresses the second part relative to the adjusting device.

10. A system according to claim 9, wherein the elastic element is comprised of two parallel elastic strips interconnecting the two parts of the supporting device.

11. A system according to claim 9, wherein the adjusting device is comprised of a rod having axially spaced first and second screwthreadings of different pitch respectively engaging in two axially aligned internal tappings that extend in the direction of the transverse trajectory and are respectively secured to the first and second parts of the supporting device.

12. A system according to claim 9, wherein the pressure of the prestress is exerted in a direction forming an angle close to 90° with the force transmitted to the second part of the supporting device resulting from the impacts of waste on the ejector.

13. A system according to claim 9, wherein the tapping secured to the first part of the supporting device is formed in a bushing, the bushing having a support collar at one end which engages the first part of the supporting device.

14. A system according to claim 13, wherein the bushing includes a portion at a second end opposite to the first end that projects into a space separating the first part and second part and is screwthreaded to allow the bushing to be locked in place by means of a nut.

15. A system according to claim 9, wherein the first part of the supporting device is connected to the frame of the rotary cutting machine by a support flange engaging a cross-member parallel to the axis of rotation of the cylinder, and further including a locking device that fixes the supporting device along the cross-member.

16. A system according to claim 15, wherein the adjusting device and the locking device are accessible on outer surfaces of the supporting device situated in planes parallel to the axis of rotation of the cylinder.

17. A system according to claim 15, further including a plurality of supporting devices, each of the supporting devices being in engagement with the cross-member, and each associated with one of a plurality of ejectors.

* * * * *